US006146770A

United States Patent [19]

Sargeant et al.

[11] Patent Number: 6,146,770

[45] Date of Patent: Nov. 14, 2000

[54] FAST DRYING INK JET RECORDING MEDIUM HAVING A HUMIDITY BARRIER LAYER

[75] Inventors: Steven J. Sargeant, West Warwick; Nathan Jones, Smithfield, both of R.I.; Joshua Rundus, Fullerton, Calif.; Shengmei Yuan, Coventry, R.I.

[73] Assignee: Arkwright Incorporated, Fiskeville, R.I.

[21] Appl. No.: 09/257,051

[22] Filed: Feb. 25, 1999

Related U.S. Application Data

[60] Provisional application No. 60/076,060, Feb. 26, 1998.

[51] Int. Cl.[7] ..... B41M 5/00

[52] U.S. Cl. ..... 428/500; 428/195; 428/423.1; 428/521; 428/532

[58] Field of Search ..... 428/195, 423.1, 428/500, 521, 532

[56] References Cited

U.S. PATENT DOCUMENTS

| | | |
|---|---|---|
| 4,642,247 | 2/1987 | Mouri et al. . |
| 4,780,356 | 10/1988 | Otouma et al. . |
| 4,785,313 | 11/1988 | Higuma et al. . |
| 4,879,166 | 11/1989 | Misuda et al. . |
| 4,956,230 | 9/1990 | Edwards et al. . |
| 5,104,730 | 4/1992 | Misuda et al. . |
| 5,182,175 | 1/1993 | Sakaki et al. . |
| 5,190,805 | 3/1993 | Atherton et al. . |
| 5,275,867 | 1/1994 | Misuda et al. . |
| 5,679,451 | 10/1997 | Kondo et al. . |

FOREIGN PATENT DOCUMENTS

| | | |
|---|---|---|
| 0696516A1 | 2/1996 | European Pat. Off. . |
| WO 9626841 A1 | 9/1996 | WIPO . |

*Primary Examiner*—Pamela R. Schwartz
*Attorney, Agent, or Firm*—Birch, Stewart, Kolasch & Birch, LLP

[57] ABSTRACT

The present invention is directed to an ink jet recording medium. The ink jet recording medium has an ink absorbent layer provided upon a substrate, with a humidity barrier layer provided upon the ink absorbent layer. The ink absorbent layer comprises a blend of poly(2-ethyl-2-oxazoline), poly(vinyl pyrollidone), and a hydrophobic polymer, and the humidity barrier layer comprises a blend of polyethylene oxide and boehmite alumina. The ink jet recording medium is fast drying over different relative humidity conditions, making it particularly suitable for high speed printing applications.

13 Claims, No Drawings

FAST DRYING INK JET RECORDING MEDIUM HAVING A HUMIDITY BARRIER LAYER

CROSS-REFERENCE TO RELATED APPLICATIONS

This application claims the benefit of U.S. provisional application Ser. No. 60/076,060 having a filing date of Feb. 26, 1998, now abandoned.

BACKGROUND OF THE INVENTION

1. Field of the Invention

The present invention relates to an ink jet recording medium suitable for a variety of applications including overhead presentations, and graphic art, engineering, and home office projects. The ink jet recording medium comprises a substrate coated with an ink absorbent layer and a humidity barrier layer.

2. Brief Description of the Related Art

Ink jet printing technology is used for a variety of applications including overhead presentation, graphic art, engineering, and home office applications. An ink jet recording medium must meet important performance criteria such as low ink migration, large color gamut, good color fidelity and high image resolution. A particularly important performance criterion is the ability to dry very quickly after ink application. As ink jet printing technology advances and printing speed increases, it is important that the ink jet recording media dry quickly enough to keep up with the speed of the printer. It is also important that the ink jet recording medium function well in a variety of environmental humidity ranges.

The following media are known from the literature, each of which differs significantly from the present inventive ink jet recording medium.

Misuda et al., U.S. Pat. No. 5,275,867 provides a recording film comprising a transparent substrate, a porous alumina hydrate layer formed on the substrate and an opaque porous layer laminated on the alumina hydrate layer.

Atherton et al., U.S. Pat. No. 5,190,805 provides a film medium useful in ink jet printing, which film comprises a transparent or opaque substrate, having on at least one side thereof an annotatable water-insoluble, water absorptive and ink-receptive matrix, said matrix comprised of a hydrogel complex and a pigment.

Sakaki et al., U.S. Pat. No. 5,182,175 provides a recording medium comprising a substrate and an ink-receiving layer provided thereon wherein the ink receiving layer contains water-insoluble and amorphous basic aluminum salt. The aluminum salt is represented by the general formula $Al_x(OH)_yX_z$ where X is an acid radical and x, y, and z are respectively positive integers and satisfy the relations of $z=3X-y$, and $x/z \geqq 3$.

Misuda et al., U.S. Pat. No. 5,104,730 provides a recording sheet comprising a substrate and a porous layer of ink absorbent formed thereon, wherein the porous layer of ink absorbent is made mainly of pseudoboehmite.

Edwards et al., U.S. Pat. No. 4,956,230 provides a transparent sheet for use with ink jet printers and pen plotters which utilize hydrophilic solvent-based inks. The sheet comprises a transparent backing bearing on at least one major surface thereof a transparent coating formed of a blend of at least one hydrophilic polymer containing a carbonylamido functional group and at least one hydrophobic polymer substantially free of acidic functional groups, hydroxyl groups, >NH groups and —$NH_2$ groups.

Misuda et al., U.S. Pat. No. 4,879,166 provides a carrier medium for a coloring matter, which comprises an ink absorbent and a substance present on the surface of the absorbent, which has an adsorptivity of from 20 to 100 mg/g.

Otouma et al., U.S. Pat. No. 4,780,356 provides a recording sheet comprising a sheet of paper and porous particles provided on the paper surface, said porous particles having an average pore size of from 10 to 5000 Angstroms, a pore volume of from 0.05 to 3.0 cc/g and an average particle size of from 0.1 to 50 $\mu$m.

While many ink jet recording medium designs are available, there remains a need for an ink jet recording medium possessing good image quality that is fast drying in various environmental conditions. The present invention provides such an ink jet recording medium.

SUMMARY OF THE INVENTION

The present invention provides an ink jet recording medium that is fast drying and provides excellent image quality. The ink jet recording medium comprises a substrate coated with an ink absorbent layer comprising a blend of poly(2-ethyl-2-oxazoline); poly(vinyl pyrollidone); and a hydrophobic polymer, and a humidity barrier layer comprising a blend of polyethylene oxide and boehmite alumina, wherein the barrier layer is coated on the ink absorbent layer. Optionally, the barrier layer may contain a cellulose ether derivative. The ink absorbent layer is more absorbent than the humidity barrier layer, so that when ink is applied to the recording medium, it substantially passes through the humidity barrier layer and is absorbed by the ink absorbent layer.

DETAILED DESCRIPTION OF THE INVENTION

The following Detailed Description (including the examples set forth) is provided as an aid to those desiring to practice the present invention. It is not to be construed as being unduly limiting to the present inventive discovery, since those of ordinary skill in the art will readily recognize that the embodiments of the inventors' discovery disclosed herein may be modified using standard techniques and materials known in the art, without departing from the spirit or scope of the present inventive discovery.

Conventional ink jet recording media are coated with polymeric layers for absorbing aqueous inks. Under high humidity conditions, these recording media can absorb significant amounts of water prior to imaging (printing). This absorption of water vapor reduces the capacity of the media to absorb aqueous inks during imaging. Further, after imaging, the saturated media must be dried for long periods of time to completely dry the image.

The present invention provides an ink jet recording medium comprising a substrate having an ink absorbent layer and a humidity barrier layer provided upon said ink absorbent layer. As used herein, the term "humidity barrier layer" means a polymeric layer substantially permeable to water and aqueous inks but relatively resistant to water vapor absorption. This thin humidity barrier layer, with its low sensitivity to humidity, reduces the detrimental effects of humidity on the imaged media.

Although the humidity barrier layer does not significantly absorb water vapor, it will absorb aqueous inks. But, the ink absorbent layer is more absorbent to aqueous inks than the humidity barrier layer so when aqueous ink is applied to the recording medium, it substantially permeates through the humidity barrier layer and is absorbed by the ink absorbent layer.

The ink absorbent layer of the present invention comprises a blend of hydrophilic and hydrophobic polymers. The hydrophilic (i.e., water-soluble) polymers used in the ink absorbent layer are poly(2-ethyl-2-oxazoline) and poly (vinyl pyrrolidone). At least one hydrophobic (i.e., water-insoluble) polymer is also used in the ink absorbent layer and is preferably selected from the group consisting of cellulose acetate proprionate, polyvinyl butyral, polyurethane, butadiene-styrene copolymers, and mixtures thereof. Preferably, the ink absorbent layer comprises (by weight) about 70% to about 90% poly(2-ethyl-2-oxazoline), about 1% to about 15% water-insoluble polymer, and about 1% to about 15% poly(vinyl pyrrolidone), based on the weight of the ink absorbent layer.

The humidity barrier layer of the present invention comprises poly(ethylene oxide), boehmite alumina, and optionally, a cellulose ether derivative. Preferably, the humidity barrier layer of the present invention comprises (by weight) about 7% to about 42% poly(ethylene oxide) and about 58% to about 93% boehmite alumina, based on the weight of the humidity barrier layer. If a cellulose ether derivative is used in the barrier layer, the amount used should be no greater than about 50% by weight. It is particularly important that the humidity barrier layer contain poly(ethylene oxide). If the humidity barrier layer does not contain poly(ethylene oxide), the imaged medium is more sensitive to humidity, resulting in longer image drying times, as illustrated in the Examples below.

The present inventors have discovered that employing a particular solvent blend is advantageous in making the components of the ink absorbent layer admixture compatible. This solvent blend comprises various common solvents including aromatic hydrocarbons, glycol ethers, ketones, and the like, along with a polar solvent. The polar solvent may be selected from the group consisting of methanol, ethyl alcohol, n-propyl alcohol, and acetic acid, although it is not limited to these particular polar solvents. The inventors have discovered a mixture of ethyl alcohol, methyl ethyl ketone, and propylene glycol monomethyl ether to be particularly advantageous.

The ink jet recording media of this invention can be prepared with a variety of substrates including transparent, translucent, and opaque plastic films or papers. Suitable substrates include plastic films comprising polyesters, cellulose esters, polystyrenes, polypropylenes, poly(vinyl acetates), and polycarbonates, and clay-coated and polyolefin-coated papers. Polyester films are particularly preferred film substrates. Clay-coated and polyolefin-coated papers are particularly preferred paper substrates. The thickness of the base substrate is not particularly restricted.

The base substrate may be treated with a conventional adhesion promoting layer on its non-imaging surface (i.e., it backside which does not bear the two coating layers) as is known in the art. If desired, the non-imaging surface of the base substrate may have a backing material placed thereon in order to reduce electrostatic charge, reduce sheet-to-sheet friction and sticking, and reduce curl. The backing may be a polymeric coating, a polymer film, or paper.

In practice, various additives may also be employed in one or both layers. These additives include surface active agents that control the wetting or spreading action of the coating solutions, antistatic agents, suspending agents, and acidic compounds to control the pH of the coating. Other additives may also be used, if desired. The ink absorbent layer may further comprise particulate in an amount of about 0.1% to about 15% by weight of dry coating. Such particulate may be organic or inorganic. Some examples of suitable inorganic particulates include silica, alumina, kaolin, glass beads, calcium carbonate, and titanium dioxide. Suitable organic particulates include polyolefins, polystyrene, starch, poly(methyl methacrylate), and poly(tetrafluoroethylene).

The coating compositions as herein described are prepared and applied to the desired substrate to produce the ink jet recording medium. Any number of coating methods may be employed including roller coating, blade coating, wire bar coating, dip coating, extrusion coating, air knife coating, curtain coating, slide coating, doctor coating, or gravure coating. These and other such methods are well known in the art.

The coating layers are designed such that the ink jet recording medium comprises a thick ink absorbent underlayer and a thin, protective humidity barrier layer. The thin humidity barrier layer provides excellent image quality while at the same time allowing most of the applied ink to quickly permeate to the ink absorbent layer. In a preferred embodiment, the ink absorbent layer is applied to the substrate at a thickness of about 10 to about 16 grams per square meter, while the humidity barrier layer is applied to the ink absorbent layer at a thickness of about 0.5 grams per square meter to about 2 grams per square meter. The total thickness of the coating, including the ink absorbent and humidity barrier layers, is not particularly restricted, but is generally in the range of about 10 grams per square meter to about 25 grams per square meter.

EXAMPLES

The following examples are given merely as illustrative of the invention and are not to be considered as limiting to the present inventive discovery. In the following examples, the solid content of the listed ingredients is provided based on a part/part (wt./wt.) basis.

Example 1

| Layer 1: Ink Absorbent Layer | |
|---|---|
| Poly(2-ethyl-2-oxazoline)[1] | 16.8 parts |
| Cellulose Acetate Proprionate[2] | 1.8 parts |
| Poly(vinyl pyrrolidone)[3] | 1.4 parts |
| Ethyl Alcohol[4] | 15.0 parts |
| Propylene Glycol Monomethyl Ether[5] | 24.0 parts |
| Methyl Ethyl Ketone[6] | 36.0 parts |

[1]available from Polymer Chemistry Innovations
[2]available from Eastman Chemical
[3]available from ISP Corporation
[4]available from Houghton
[5]available from Dow Chemical
[6]available from Shell A coating was prepared according to the above formulation and applied to a polyester film (available from ICI Films) using a No. 40 Meyer rod. The coated film was then dried at 130° C. for 1.5 minutes.

| Layer 2: Humidity Barrier Layer | |
|---|---|
| Hydroxypropyl cellulose[1] | 0.34 parts |
| Poly(ethylene oxide)[2] | 0.80 parts |
| Boehmite Alumina[3] | 6.08 parts |
| Water | 92.78 parts |

[1]available from Dow Chemical
[2]available from Union Carbide
[3]available from Condea Vista A coating was prepared according to the above formulation and applied onto coating layer 1 using a No. 16 Meyer rod. The coated film was then dried at 95° C. for 2 minutes.

Example 2

A coating having the same formulation used for layer 1 in above Example 1 was applied to a polyolefin-coated paper (available from Jencoat) using a No. 40 Meyer rod. The paper was then dried at 130° C. for 1.5 minutes. A coating having the same formulation used for layer 2 in above Example 1 was then applied to the paper (onto the first layer) using a No. 16 Meyer rod. The coated paper was then dried at 95° C. for 2 minutes.

Example 3

| Layer 1: Ink Absorbent Layer | |
|---|---|
| Poly(2-ethyl-2-oxazoline)[1] | 3.32 parts |

-continued

| Layer 1: Ink Absorbent Layer | |
|---|---|
| Cellulose Acetate Proprionate[2] | 3.19 parts |
| Poly(vinyl pyrrolidone)[3] | 1.26 parts |
| Ethyl Alcohol[4] | 16.4 parts |
| Propylene Glycol Monomethyl Ether[5] | 19.68 parts |
| Methyl Ethyl Ketone[6] | 46.3 parts |

[1]available from Polymer Chemistry Innovations
[2]available from Eastman Chemical
[3]available from ISP Corporation
[4]available from Houghton
[5]available from Dow Chemical
[6]available from Shell A coating was prepared according to the above formulation and applied to a polyester film (available from ICI Films) using a No. 40 Meyer rod. The film with coating layer 1 was then dried at 130° C. for 1.5 minutes.

| Layer 2: Humidity Barrier Layer | |
|---|---|
| Hydroxypropyl cellulose[1] | 0.35 parts |
| Poly(ethylene oxide)[2] | 0.83 parts |
| Boehmite Alumina[3] | 6.32 parts |
| Water | 92.50 parts |

[1]available from Dow Chemical
[2]available from Union Carbide
[3]available from Condea Vista A coating was prepared according to the above formulation and applied to coating layer 1 of the film using a No. 20 Meyer rod. The coated film was then dried at 95° C. for 2 minutes.

Comparative Example A

An interlayer coating comprising poly(2-ethyl-2-oxazoline) and a hydrophobic polymer was applied to a polyester film. The film with the interlayer coating was then dried at 130° C. for 1.5 minutes. A top layer comprising a blend of cellulose ethers and boehmite alumina was then applied to the interlayer. Neither the interlayer nor top layer coating contained any polyethylene oxide. The coated film was then dried at 95° C. for 2 minutes.

In order to illustrate the relative insensitivity to environmental conditions (temperature and humidity) Comparative Example A and Example 2 were printed on an HP Deskjet® 660C at various temperatures and relative humidity conditions, and the drying times were measured (Table 1). As shown in Table 1, Comparative Example A has longer drying times with a relatively large variation in drying times, whereas Example 2 has shorter drying times with a relatively small variation in drying times.

TABLE 1

| | Drying Time (minutes) | | | | | | |
|---|---|---|---|---|---|---|---|
| Sample | 59° F. 20% RH | 86° F./ 20% RH | 73° F./ 50% RH | 59° F./ 80% RH | 86° F./ 80% RH | Average | Std. Deviation |
| Example 2 | 0.8 | 0.2 | 0.4 | 0.9 | 0.8 | 0.62 | 0.3 |
| Comparative Example A | 2.5 | 1.3 | 4.0 | 4.0 | 3.1 | 2.98 | 1.13 |

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet recording medium comprising a substrate coated with an ink absorbent layer comprising a blend of poly(2-ethyl-2-oxazoline), poly(vinyl pyrollidone), and a hydrophobic polymer, and a humidity barrier layer comprising a blend of polyethylene oxide and boehmite alumina, said barrier layer coated on the ink absorbent layer.

2. The ink jet recording medium according to claim 1, wherein the hydrophobic polymer is selected from the group consisting of cellulose acetate proprionate, polyvinyl butyral, polyurethane, butadiene-styrene copolymers, and mixtures thereof.

3. The ink jet recording medium according to claim 1, wherein the humidity barrier layer further comprises a cellulose ether.

4. The ink jet recording medium according to claim 3, wherein the cellulose ether comprises, by weight, no greater than about 50% of the humidity barrier layer.

5. The ink jet recording medium according to claim 1, wherein the poly(2-ethyl-2-oxazoline) comprises, by weight, about 70% to about 90% of the ink absorbent layer.

6. The ink jet recording medium according to claim 1, wherein the hydrophobic polymer comprises, by weight, about 1% to about 15% of the ink absorbent layer.

7. The ink jet recording medium according to claim 1, wherein the poly(vinyl pyrollidone) comprises, by weight, about 1% to about 15% of the ink absorbent layer.

8. The ink jet recording medium according to claim 1, wherein the polyethylene oxide comprises, by weight, about 7% to about 42% of the humidity barrier layer.

9. The ink jet recording medium according to claim 1, wherein the boehmite alumina comprises, by weight, about 58% to about 93% of the humidity barrier layer.

10. The ink jet recording medium according to claim 1, wherein the substrate is selected from the group consisting of transparent, translucent, and opaque plastic films, and papers.

11. The ink jet recording medium according to claim 10, wherein the substrate is a plastic film comprising a polymer selected from the group consisting of polyesters, cellulose esters, polystyrenes, polypropylenes, poly(vinyl acetates), and polycarbonates.

12. The ink jet recording medium according to claim 11, wherein the plastic film comprises polyester.

13. The ink jet recording medium according to claim 1, wherein the substrate is selected from the group consisting of clay-coated and polyolefin-coated papers.

* * * * *